US005614035A

United States Patent [19]

Nadkarni

[11] Patent Number: 5,614,035

[45] Date of Patent: Mar. 25, 1997

[54] NONABRASIVE, CORROSION RESISTANT, HYDROPHILIC COATINGS FOR ALUMINUM SURFACES, METHODS OF APPLICATION, AND ARTICLES COATED THEREWITH

[75] Inventor: Sadashiv K. Nadkarni, Lexington, Mass.

[73] Assignee: Alcan International Limited, Montreal, Canada

[21] Appl. No.: 547,151

[22] Filed: Oct. 24, 1995

Related U.S. Application Data

[62] Division of Ser. No. 128,907, Sep. 29, 1993, Pat. No. 5,514,478.

[51] Int. Cl.[6] ..... C23C 22/07

[52] U.S. Cl. ..... 148/250

[58] Field of Search ..... 148/250

[56] References Cited

U.S. PATENT DOCUMENTS

| | | | |
|---|---|---|---|
| 4,273,592 | 6/1981 | Kelly . | |
| 4,308,079 | 12/1981 | Venables | 148/250 |
| 4,349,457 | 9/1982 | Orillion . | |
| 4,376,814 | 3/1983 | Walls . | |
| 4,505,748 | 3/1985 | Baxter | 148/250 |
| 4,659,395 | 4/1987 | Sugama et al. . | |
| 4,718,482 | 1/1988 | Iwama et al. . | |
| 4,895,608 | 1/1990 | Bibber . | |
| 4,957,159 | 9/1990 | Mizoguchi et al. . | |
| 5,012,862 | 5/1991 | Espeut . | |
| 5,014,774 | 5/1991 | Siak et al. . | |
| 5,034,358 | 7/1991 | MacMillan . | |
| 5,059,258 | 10/1991 | Wefers | 148/250 |
| 5,079,087 | 1/1992 | Lever et al. . | |
| 5,137,067 | 8/1992 | Espeut . | |

FOREIGN PATENT DOCUMENTS

| | | |
|---|---|---|
| 0078866 | 5/1983 | European Pat. Off. . |
| 0089510 | 9/1983 | European Pat. Off. . |
| 2186547 | 1/1974 | France . |
| 2246653 | 5/1975 | France . |
| 2316351 | 1/1977 | France . |
| 2550551 | 1/1985 | France . |
| 60-169569 | 9/1985 | Japan . |
| 1108231 | 4/1989 | Japan . |
| 2103133 | 4/1990 | Japan . |
| 882856 | 11/1961 | United Kingdom . |

OTHER PUBLICATIONS

6001 Chemical Abstracts vol. 104, No. 4, Jan. 1986 p. 232, Abstract 104:23178u.

*Primary Examiner*—Sam Silverberg
*Attorney, Agent, or Firm*—Cooper & Dunham LLP

[57] ABSTRACT

A nonabrasive, corrosion-resistant, hydrophilic coating on aluminum sheet such as fin stock, produced by applying to the sheet surface a coating material containing, in an aqueous vehicle, effective amounts of nitrilotrismethylenetriphosphonic acid, phosphoric acid, and borate material of the group consisting of zinc borate and sodium borate, and essentially free of silica, alumina and precursors thereof, and heating the surface to establish the coating thereon. The coating formulation may also contains up to about 1 wt. % of polyacrylic acid and a surfactant to aid in application.

11 Claims, No Drawings

NONABRASIVE, CORROSION RESISTANT, HYDROPHILIC COATINGS FOR ALUMINUM SURFACES, METHODS OF APPLICATION, AND ARTICLES COATED THEREWITH

This is a division of application Ser. No. 128,907, filed Sep. 29, 1993, U.S. Pat. No. 5,514,478.

BACKGROUND OF THE INVENTION

This invention relates to the provision of corrosion resistant, hydrophilic coatings for surfaces of aluminum articles. In particular aspects it is directed to coating compositions, methods of applying them, and aluminum articles having surfaces so coated. Illustrative examples of articles that may be beneficially coated in accordance with the invention include, without limitation, aluminum foil, and aluminum sheet from which various types of components and products are formed. The term "aluminum" is used herein to refer to aluminum metal and aluminum-based alloys.

For certain purposes, aluminum articles, e.g. sheet articles, are desirably provided with hydrophilic surfaces. One commercially important example is the aluminum fin stock (sheet aluminum, in final gauge) from which fins are made for heat exchangers in air conditioners. Water condensing on the surfaces of the closely spaced fins in an air conditioner tends to accumulate in the form of drops that impede airflow between the fins, thereby reducing heat exchange efficiency. This problem can be overcome by producing the fins from fin stock having a hydrophilic coating on its surfaces; the coating allows water to drain from the fin surfaces and largely prevents the development and retention of airflow-obstructing drops. Since the environment of use of the fins is relatively severe, it is desirable that the coating also afford protection against corrosion.

A satisfactory hydrophilic and corrosion-resistant coating for fin stock or the like must be smooth and nonporous with relatively uniform thickness. To these ends, as well as to ensure that it remains durably on the fins which are formed from the stock, a strong bond must be formed between the material of the coating and the coated aluminum surface; otherwise, as the coating is dried or cured with heat after application, it may tend to move relative to the surface, developing regions of differing thickness and/or shrinkage cracks. In addition, the coating must maintain good corrosion resistant and hydrophilic properties over extended periods of exposure to water; it should be nontoxic and environmentally acceptable in application, use and recycling, as well as being inexpensive, easy to apply, and free from tackiness or stickiness.

Heretofore, a variety of hydrophilic coating systems have been proposed for imparting hydrophilicity to aluminum surfaces. A serious difficulty presented by many of the known coating formulations is that oxide material (such as silica or alumina or their precursors), included therein to impart hydrophilicity, renders the produced coatings abrasive. The abrasive character of the coatings causes increased wear of the tooling used in air conditioner fabrication, i.e., incident to forming or other operations performed on fin stock thus coated.

It is also known that polymers of a polar nature, such as polyvinyl alcohol and polyacrylic acid, can provide satisfactorily hydrophilic films. Such films, however, tend to absorb water and swell, and then afford little or no corrosion resistance. Attempts have been made to stabilize the polymers by cross-linking but these attempts have not yet achieved successful results.

SUMMARY OF THE INVENTION

The present invention, in a first aspect, broadly contemplates the provision of an aluminum article having a surface bearing a nonabrasive, corrosion-resistant, hydrophilic coating produced by applying to the surface a coating formulation comprising, in an aqueous vehicle, effective minor amounts of nitrilotrismethylene-triphosphonic acid, phosphoric acid, and borate material of the group consisting of zinc borate and sodium borate, and essentially free of silica, alumina and precursors thereof, and heating the surface to establish the coating thereon.

Further in accordance with the invention, an effective minor amount of polyacrylic acid is advantageously incorporated in the coating material. Zinc borate, viz. $2ZnO \cdot 3B_2O_3 \cdot 3.5H_2O$, preferably together with additional ZnO, and optionally $Na_2B_4O_7 \cdot 10H_2O$, is currently preferred as the borate material. An effective minor amount of a surfactant (e.g. aluminum polymethacrylate, ethoxylated octyl phenol) to facilitate application can also be included in the formulation.

The term "minor amount" as used herein refers to an amount of less than 50%. All percentage values of coating formulation ingredients set forth herein are expressed as percent by weight of total coating material (including the aqueous vehicle) unless otherwise specifically stated.

The amounts of the various ingredients used are those that are effective, in the formulations employed (i.e. in conjunction with the other ingredients present) to provide strongly bonded, smooth, nonporous hydrophilic and corrosion resistant coatings on aluminum surfaces, at least substantially free of tackiness or stickiness. Advantageously or preferably, the amounts of the ingredients used, in combination, are effective to provide a coating on said surface producing a stable contact angle with water of not more than about 15° (preferably not more than about 10°) and/or to produce corrosion resistance such that when the coated surface is exposed to a 10 weight percent copper sulfate- 1 weight percent hydrochloric acid solution, a period of at least about one minute elapses before gas bubbles appear.

The contact angle is a measure of hydrophilicity; i.e., the smaller the contact angle, the more hydrophilic the coating is. Stability of contact angle refers to the maintenance of the contact angle below the stated value (15° or, preferably, 10°) throughout a period of essentially continuous immersion in water up to about two weeks; when once the immersion period exceeds two weeks, the contact angle invariably decreases.

Currently preferred broad limits or ranges for the various ingredients in the coating formulation or feed for application to the aluminum surfaces are as follows: about 2.5 to about 7.8 parts by weight of nitrilotrismethylenetriphosphonic acid measured as a solution at 50% concentration, about 1.7 to about 6.1 parts by weight of phosphoric acid measured as 85% concentration $H_3PO_4$, about 0 to about 4.3 parts by weight of $2ZnO \cdot 3B_2O_3 \cdot 3.5H_2O$, about 0 to about 2.6 parts by weight of ZnO, about 0 to about 4.3 parts by weight of sodium borate measured as $Na_2B_4O_7 \cdot 10H_2O$, about 0 to about 0.9 parts by weight of polyacrylic acid, about 0.008 to about 0.17 parts by weight of surfactant, balance essentially water, subject to the provisos that the total of nitrilotrismethylenetriphosphonic acid and phosphoric acid present is between about 7.7 and about 12.1 parts by weight, that the total of $2ZnO \cdot 3B_2O_3 \cdot 3.5H_2O$, ZnO, and sodium borate present is between about 1.3 and about 5.2 parts by weight, and that the amount of water present (exclusive of combined water, and water in the acid solutions) is between about 100-P and about 200-P parts by weight where P is the total parts by weight of ingredients other than water present in the formulation.

The invention affords water-stable coatings that are desirably hydrophilic (typically characterized by a stable contact angle with water of 10° or less), satisfactorily corrosion resistant for use on fin stock (for example) or the like, nontoxic, and environmentally acceptable, as well as being adequately uniform and adherent to the aluminum surfaces to which they are applied, and free from tackiness or stickiness. At the same time, owing to the absence of silica, alumina, and precursors thereof from the coating formulation, they are advantageously nonabrasive, leading to reduced wear of tooling used to perform post-coating operations on the coated metal, as in the fabrication of air conditioners.

A further advantage of the invention is that coatings having these attributes can be achieved with short curing times at relatively low temperatures. For instance, curing can be performed by heating the metal to reach a peak metal temperature of around 160°–210° C. This can be achieved by heating the sheet at an oven temperature of 250°–300° C. for a few seconds of residence time. The peak metal temperature is in any event kept below about 225° C., as curing at higher peak metal temperatures results in degradation of the organic components of the coating material and causes an increase in contact angle.

The "peak metal temperature," as referred to herein, is the highest temperature reached by the metal sheet during the heating step, while the "oven temperature" is the temperature set on the control of the oven or furnace employed to provide the heating. It will be appreciated that although two ovens or furnaces can be set at the same temperature setting, the metal surface does not necessarily reach the same maximum temperature in each. For example, in a convective furnace, the metal surface will reach a higher temperature than in a nonconvective furnace. The data given in the detailed description below were obtained using a nonconvective laboratory furnace, but in industrial practice a moving web or sheet of aluminum will pass through a convective furnace.

The articles coated in accordance with the invention, in each of the abovedescribed embodiments, may be aluminum sheet articles. In particular, the invention has been found highly advantageous for the coating of aluminum fin stock as used to produce heat exchanger fins for air conditioners. The coated surfaces of the fin stock or other aluminum sheet are satisfactorily hydrophilic and corrosion resistant, and these properties are maintained over extended periods of use in exposure to water.

In additional aspects, the invention contemplates the provision of compositions and methods for producing a hydrophilic and corrosion resistant coating as described above on surfaces of aluminum articles, including aluminum sheet, and in particular aluminum fin stock.

Further features and advantages of the invention will be apparent from the detailed description hereinbelow set forth.

DETAILED DESCRIPTION

For purposes of specific illustration, the invention will be particularly described with reference to the provision of hydrophilically coated aluminum fin stock for air conditioner heat exchangers. Such fin stock is aluminum sheet which has been rolled to final gauge and is ready for cutting to form heat-exchanger fins; suitable alloy compositions, gauges, and tempers of such stock are well-known in the art and accordingly need not be further specified. Thus, exemplary products of the invention are fin stock sheets bearing hydrophilic, corrosion resistant coatings in accordance with the invention; when the fin stock is cut and formed into fins, these coatings are retained on the fin surfaces to impart the desired hydrophilic and corrosion resistant properties thereto. However, while the coating of aluminum fin stock represents a currently important commercial application of the invention, it is to be understood that in a broader sense the invention may be employed in coating a wide variety of aluminum articles, notably including sheet articles, for which a hydrophilic coating that is also corrosion resistant is desired.

The invention contemplates the provision of a coating feed (i.e. liquid coating material or composition, ready for application to aluminum fin stock or other aluminum surfaces) comprising, in an aqueous vehicle, effective minor amounts of nitrilotrismethylenetriphosphonic acid, phosphoric acid, and borate material of the group consisting of zinc borate and sodium borate, preferably also including an effective minor amount of polyacrylic acid, and essentially free of silica, alumina and precursors thereof. An effective minor amount of a surfactant is usually or preferably also incorporated in the formulation, to promote wetting of surfaces incident to application.

The several ingredients of the coating composition will now be further described.

Nitrilotrismethylenetriphosphonic acid—it is currently preferred to use a 50 weight % aqueous solution of nitrilotrismethylenetriphosphonic acid (hereinafter sometimes abbreviated "NTPA") in the coating feeds of the invention, and amounts of NTPA are expressed herein as amounts of such solution. The NTPA contributes to the corrosion resistance of the produced coatings. For obtaining a stable coating, the amount of NTPA (i.e. 50% solution) present in the applied coating material should exceed 2.5%, and more preferably (in at least many instances) should be in a range of 2.9% to 7.8%. Amounts of NTPA above 7.8% tend to increase the tackiness of the produced coating on absorption of moisture, and also add unnecessarily to the cost of the coating.

Phosphoric acid—It is currently preferred to use orthophosphoric acid ($H_3PO_4$) in an 85 weight % aqueous solution, and amounts of phosphoric acid are expressed herein as amounts of such solution. The phosphoric acid content of the coating feed is essential to maintain contact angle stability over time. It is therefore generally preferred that the phosphoric acid content be at least about 1.7% and more preferably between 2.9% and 5.2%.

Zinc borate—Zinc borate is conveniently employed in the form $2ZnO \cdot 3B_2O_3 \cdot 3.5H_2O$ (sometimes hereinafter abbreviated "ZB"). The zinc oxide:boric oxide mole ratio of the zinc borate material may be increased, above that of ZB, by adding zinc oxide powder (ZnO). As used herein, the term "zinc borate" embraces ZB with or without additional ZnO. It is necessary to include zinc borate and/or sodium borate in order to achieve the desired hydrophilic property of the coating, zinc borate being preferred because it gives better corrosion resistance than sodium borate. The amount used should not exceed the limit of solubility in the coating formulation, which is dependent on the concentration of acids (NTPA and phosphoric acid) present.

Sodium borate—In addition to or in substitution for zinc borate, sodium borate (sometimes hereinafter abbreviated "NAB") may be used in the formulation, conveniently in the decahydrate form, $Na_2B_4O_7 \cdot 10H_2O$. Zinc borate and sodium borate may be used together, with or without added zinc oxide.

Polyacrylic acid—The polyacrylic acid used may, for example, be the product commercially available under the trade name "Acusol" from Rohm & Haas. Polyacrylic acid (sometimes hereinafter abbreviated "PAA") contributes to the hydrophilicity (reduction in contact angle) of the coating. However, when its concentration in the coating feed exceeds about 1%, the coated surface becomes tacky with time owing to absorption of moisture. This tackiness is undesirable as it can cause the coated sheet to stick to the rubber rolls used to advance the sheet during fabrication of fins or other elements. It is therefore preferred to maintain the polyacrylic acid concentration below about 1%.

Surfactant—a surfactant is added only to facilitate wetting of surfaces during coating application. It does not impart hydrophilicity or otherwise affect the performance of the coating. Aluminum fin stock sheet in "O" temper (fully annealed) can be wetted by coating feeds of the invention containing polyacrylic acid without surfactant, but it is difficult to wet the chrome-plated rolls used in roll-coating application of the feed to the aluminum surfaces. Suitable surfactants are aluminum polymethacrylate (sometimes hereinafter abbreviated "APMA"), commercially available under the trade name "Darvan C" from R. T. Vanderbilt & Co., and ethoxylated octyl phenol (sometimes hereinafter abbreviated "EOP"), commercially available under the trade name "Nonidet P-40" from Sigma Chemicals. Only a very small amount of surfactant (usually less than 0.1%) is used.

In the practice of the method of the invention, the coating composition or feed is first prepared by dissolving the described ingredients in water. The resulting aqueous feed is then applied to the fin stock or other aluminum surface to be coated, using any convenient application procedure, e.g., immersion, roller-coating, spin-coating, spraying, or painting, in accordance with techniques well-known in the art.

After application of the feed, the fin stock or other coated aluminum article is heated (to remove water and other volatiles, and thereby to establish a dried coating on the aluminum surfaces) so as to reach a peak metal temperature of about 160°–210° C., and in any event below 225° C. This typically involves placing the sheet, with the applied feed, in an oven maintained at 250°–300° C., for a few seconds of residence time. The drying of the applied coating by the described heating step completes the coating procedure. It is important that the peak metal temperature be kept below 225° C. to prevent impairment of the hydrophilic properties of the coating.

The coatings thus produced by the method of the invention are advantageously hydrophilic, characterized by a contact angle with water below 15°, and with preferred formulations, not more than about 10°. The contact angle does not increase significantly, i.e. above the maxima just mentioned, with extended exposure to water. The exposure time of concern is the period represented by up to about two weeks of continuous immersion in water, since the contact angle invariably decreases thereafter. The contact angle also remains adequately stable when exposed to cooling oils normally employed in the industry during fabrication of fins.

Owing to the absence of silica, alumina and their precursors, the coatings are nonabrasive, and therefore do not cause tool wear during fabrication of fins or the like. In addition, they are inexpensive, do not contain any toxic substances, and do not present problems in application or use; in particular, they do not become inconveniently tacky or sticky. They also provide a satisfactory degree of corrosion resistance to the surfaces to which they are applied.

Preferably the amounts or proportions of the several ingredients of the coating feed are such as to be effective, in combination, to provide a coating producing a contact angle with water of not more than about 10°. Preferably, also, these amounts or proportions are such as to be effective to provide a coating having corrosion resistance such that when the coated surface is exposed to a 10 weight percent copper sulfate–1 weight percent hydrochloric acid solution, a period of at least about one minute elapses before gas bubbles appear.

The relative proportions of the various ingredients of the coating feed (other than water) are important for the attainment of the desired coating properties. Broad and currently preferred ranges of such relative proportions (expressed as parts by weight) are set forth in TABLE 1 below, which defines these relative proportions in terms of specifically identified, convenient or preferred forms of these ingredients. In addition to the ingredients listed, other components may be included in the coating feed formulation. Small amounts of substances such as inorganic salts, other acids or organic derivatives can also be added to or be present in the feed without adverse effects but do not appear to improve the properties of the coating.

The balance of the coating feed (i.e., apart from the ingredients listed in TABLE 1) is essentially water. A currently preferred concentration for the aqueous coating feed is that at which the parts by weight listed in TABLE 1 are in fact percentages by weight of the listed ingredients, the balance of the composition being water. However, in at least some instances this concentration may be diluted up to half strength by addition of water, such that the percentage by weight of each ingredient is numerically equal to half the value of parts by weight given in TABLE 1. That is to say, at least over this indicated wide range, the amount of water in the coating feed is not critical to the performance of the coating, although higher dilution results in a thinner coating and may consequently reduce the corrosion resistance and/or otherwise decrease the time the coating will last in service, which could nevertheless be within acceptable limits for some applications.

Examples of five specific currently preferred coating formulations, within the ranges set forth in TABLE 1, are given in TABLE 2 below. Each of these preferred formulations is represented by one of the coating feeds described in the specific examples that follow. All of the formulations of TABLE 2 are given in % by weight (of the total coating feed, including water) at full-strength concentration.

In these tables, and in the formulations given in the specific examples that follow, amounts and proportions of water set forth do not include water incorporated in the starting materials, e.g. in the acids.

TABLE 1

NTPA = nitrilotrismethylenetriphosphonic acid (50%, in water)
$H_3PO_4$ = orthophosphoric acid (85%, in water)
ZB = $2ZnO \cdot 3B_2O_3 \cdot 3.5H_2O$
ZnO = zinc oxide powder
NAB = sodium borate decahydrate, $Na_2B_4O_7 \cdot 10H_2O$
PAA = polyacrylic acid (trade name "Acusol")

| Ingredient | Parts by Weight | |
|---|---|---|
| | Broad Range | Preferred Range |
| (1) NTPA | 2.5–7.8 | 2.9–7.8 |
| (2) $H_3PO_4$ | 1.7–6.1 | 2.9–5.2 |
| SUBTOTAL OF (1) + (2) | 7.7–12.1 | 7.7–11.2 |
| (3) ZB | 0–4.3 | 0.8–2.2 |
| (4) ZnO | 0–2.6 | 0.8–2.6 |
| SUBTOTAL OF (3) + (4) + NAB | 1.3–5.2 | 1.3–5.2 |
| (5) PAA | 0–0.9 | 0.07–0.43 |
| (6) Surfactant | 0.008–0.17 | 0.008–0.10 |

TABLE 2

APMA = aluminum polymethacrylate (trade name "Darvan C")
EOP = ethoxylated octyl phenol (trade name "Nonidet P-40")

| Ingredient | balance water, in all compositions | | | | |
|---|---|---|---|---|---|
| | % by weight | | | | |
| | I | II | III | IV | V |
| NTPA | 5.19 | 6.94 | 3.12 | 5.18 | 5.19 |
| $H_3PO_4$ | 4.14 | 3.47 | 5.20 | 4.15 | 4.14 |
| ZB | 1.73 | 1.73 | 1.73 | 1.16 | 1.73 |
| ZnO | 2.02 | 1.02 | 2.03 | 1.35 | 2.02 |
| NAB | 0 | 0 | 0 | 1.35 | 0.00 |
| PAA | 0.43 | 0.35 | 0.28 | 0.43 | 0.43 |
| APMA | 0.09 | 0.09 | 0.07 | 0.00 | 0.00 |
| EOP | 0 | 0 | 0 | 0.017 | 0.02 |

By way of further illustration of the invention, reference may be made to the following specific examples, wherein all ingredients used are those specifically identified in TABLES 1 and 2. Data for EXAMPLES 1–6 are set forth in TABLES 3 and 4 below, while data for EXAMPLES 7–9 are set forth in TABLES 5 and 6 below.

EXAMPLE 1

Coating formulations 1-1 and 1-2 set forth in TABLE 3 were prepared and applied to surfaces of small aluminum fin stock sheets in "O" temper (fully annealed) by roll coating, using chrome-plated rolls. The coatings were dried by heating the sheets in an oven for a few seconds, to achieve a peak metal temperature of about 160°–200° C.

Immediately thereafter, contact angles with water were measured for the coatings thus applied. Samples of the test sheets were then continuously immersed in water (which was changed daily) for periods of 4, 8, 12 and 16 days. At the end of each of these periods, the contact angle with water was measured for each coating. The results are given, for coatings 1-1 and 1-2, in TABLE 4, wherein "Initial" refers to the initial contact angle measurement (i.e., before any immersion in water) and the number of days of immersion before each subsequent test are indicated.

This example illustrates the effect of the addition of polyacrylic acid on hydrophilicity. Although both coatings 1-1 and 1-2 met the requirement of providing stable contact angles (throughout a 2-week period) below 15°, coating 1-2 (which contained 0.43% polyacrylic acid) exhibited a significant reduction in contact angle as compared to coating 1-1, which contained no polyacrylic acid.

Coating 1-2 is the currently especially preferred composition I set forth in TABLE 2 above.

EXAMPLE 2

The procedure of EXAMPLE 1 above was repeated, using the coating formulations identified as 2-1, 2-2, and 2-3, to show the effect of phosphoric acid on maintenance of a stable low contact angle. As TABLE 4 shows, in the case of coating 2-1, which contained no phosphoric acid, the contact angle was substantially higher than 15° for much of the immersion test period, and progressively better results were achieved (coatings 2-2 and 2-3) as the proportion of phosphoric acid was increased.

EXAMPLE 3

Further samples of the "O" temper aluminum fin stock sheet were coated with coating formulations 3-1 and 3-2 set forth in TABLE 3, again using the applying and drying procedure described in EXAMPLE 1.

To demonstrate the effect of NTPA in the composition on the corrosion resistance of the produced coatings, these samples, and also a sheet coated with formulation 1-2 as described in EXAMPLE 1, were tested for corrosion resistance by placing a drop of a solution containing 10 weight % copper sulfate and 1 weight % hydrochloric acid on the coated aluminum sheet, and observing the time elapsed before hydrogen bubbles became visible.

The sample coated with formulation 3-1, containing no NTPA, exhibited the least corrosion resistance; hydrogen bubbles evolved after a lapse of about 15 seconds. In the case of the sample coated with formulation 3-2, containing 2.6% NTPA, hydrogen bubbles were seen after a lapse of 40 seconds. The sample coated with formulation 1-2, containing 5.19% NTPA displayed superior resistance to corrosion, in that about 150 seconds elapsed before gas bubbles evolved.

EXAMPLE 4

The procedure described in EXAMPLE 1 above, including the contact angle stability tests, was again repeated, using coatings 4-1, 4-2, and 4-3 set forth in TABLE 3, and results were compared with those obtained for samples coated with formulations 1-2 (EXAMPLE 1) and 2-3 (EXAMPLE 2), to ascertain the effect of varying amounts of zinc borate and zinc oxide. In these compositions, the mole ratio of ZnO to $B_2O_3$ was as follows:

| Coating No. | $ZnO/B_2O_3$ Mole Ratio |
|---|---|
| 4-1 | 0/0 |
| 4-2 | 0.67 |
| 2-3 | 1.5 |
| 4-3 | 1.75 |
| 1-2 | 2.75 |

Coating 4-1, containing no ZB or ZnO, exhibited no corrosion resistance, and was not tested for contact angle. As shown in TABLE 4, of those that were tested, the lowest stable contact angle was achieved by coating 1-2, which had the highest concentration of zinc borate (ZB+ZnO=3.75%). It was also observed that when the overall concentration of zinc borate was below 2%, the coating became tacky after exposure to air and moisture. Least tackiness was observed when the concentration of zinc borate exceeded 2%.

The amount of zinc borate that could be dissolved in the coating formulation depended on the concentration of the two acids NTPA and $H_3PO_4$. At the levels of acid concentration in the formulations tested, the maximum zinc borate concentration was limited to about 3.2%.

It was also observed that when the coating feed (i.e., the initial formulation in water) was exposed to air for periods of 8 hours or more, a precipitate was formed. This can be avoided by replacing part of the zinc borate and zinc oxide with sodium borate. It is believed that formation of a precipitate also occurs on the coated sheet; the coating becomes increasingly insoluble in water with time when exposed to air.

EXAMPLE 5

The procedure of EXAMPLE 1 was repeated using coating formulation 5-1 of TABLE 3, with the results (contact angle stability) shown in TABLE 4. Coating 5-1 is the same as the preferred coating composition II of TABLE 2.

Aluminum sheet samples coated with each of formulations 1-2 (EXAMPLE 1) and 5-1 were immersed in the cooling oil identified by trade name "Arrow 688" for 24 hours and then air dried. In the case of formulation 5-1, the contact angle with water increased from 8.2° before oil immersion to 19° after oil immersion. For the simple coated with formulation 1-2, the contact angle with water increased from 5.4° before oil immersion to 7.4° after oil immersion. These results show that with the optimum formulation (1-2), the coating retains its hydrophilic nature even after exposure to cooling oil.

EXAMPLE 6

The procedure of EXAMPLE 1 was again repeated using coating 6-1 of TABLE 3. Contact angle stability results were as shown in TABLE 4. Coating 6-1 is the preferred composition III of TABLE 2.

EXAMPLE 7

To determine the effect of substituting sodium borate (NAB, as identified in TABLE 1) for zinc borate in the coating feed, two further coatings (A and B, TABLE 5) were prepared and applied to aluminum fin stock sheet samples in "O" temper by roll coating as in EXAMPLE 1. The coatings were then dried by heating the coated metal samples in an oven at an oven temperature of 300° C. for various time periods ranging from 12 to 15 seconds. The peak metal temperature varied between 200° and 220° C. For samples of each coating, dried for each of four periods (12, 13, 14 and 15 seconds), contact angle stability was measured by the same immersion technique as in EXAMPLE 1, except that tests were made initially and after immersion periods of 1, 4, 8, 10 and 16 days. Results are shown in TABLE 6.

These results indicate that coating B, which contained polyacrylic acid, was significantly better from the standpoint of hydrophilicity (lower stable contact angle) than coating A, which had no polyacrylic acid. When tested by the procedure of EXAMPLE 3, however, these samples exhibited inferior corrosion resistance, as hydrogen bubbles began to be generated within less than 60 seconds.

EXAMPLE 8

The procedure of EXAMPLE 1 was repeated once more with coating C of TABLE 5, containing zinc borate and oxide and also sodium borate. This composition (preferred composition IV of TABLE 2) also gave satisfactory results, as TABLE 6 shows.

TABLE 3

| Coating | balance water, in all compositions | | | | | |
|---|---|---|---|---|---|---|
| | % by weight | | | | | |
| No. | NTPA | $H_3PO_4$ | ZB | ZnO | PAA | APMA |
| 1-1 | 5.20 | 4.33 | 1.73 | 2.03 | 0.00 | 0.09 |
| 1-2 | 5.19 | 4.14 | 1.73 | 2.02 | 0.43 | 0.09 |
| 2-1 | 6.32 | 0.00 | 1.81 | 0.85 | 0.58 | 0.09 |
| 2-2 | 6.17 | 1.94 | 1.76 | 0.83 | 1.06 | 0.09 |
| 2-3 | 5.24 | 4.20 | 1.75 | 0.82 | 0.44 | 0.09 |
| 3-1 | 0.00 | 4.89 | 1.81 | 2.12 | 0.44 | 0.09 |
| 3-2 | 2.66 | 4.20 | 1.75 | 2.05 | 0.44 | 0.09 |
| 4-1 | 5.38 | 4.31 | 0.00 | 0.00 | 0.45 | 0.09 |
| 4-2 | 5.29 | 4.23 | 1.76 | 0.00 | 0.44 | 0.09 |
| 4-3 | 5.24 | 4.36 | 1.75 | 1.03 | 0.35 | 0.09 |
| 5-1 | 6.94 | 3.47 | 1.73 | 1.02 | 0.35 | 0.09 |
| 6-1 | 3.12 | 5.20 | 1.73 | 2.03 | 0.28 | 0.07 |

TABLE 4

| Coating | contact angle, degrees | | | | |
|---|---|---|---|---|---|
| No. | Initial | 4 days | 8 days | 12 days | 16 days |
| 1-1 | 11.2 | 10.6 | 12.6 | 10.0 | 10.0 |
| 1-2 | 10.4 | 4.6 | 4.8 | 8.6 | 3.2 |
| 2-1 | 7.2 | 18.0 | 24.8 | 21.6 | 3.4 |
| 2-2 | 4.6 | 22.0 | 22.4 | 14.4 | 2.2 |
| 2-3 | 6.8 | 12.8 | 12.8 | 12.4 | 12.4 |
| 4-2 | 7.4 | 7.4 | 14.2 | 11.4 | 9.8 |
| 4-3 | 3.8 | 4.0 | 17.0 | 12.8 | 2.6 |
| 5-1 | 6.0 | 5.6 | 8.4 | 10.2 | 12.2 |
| 6-1 | 11.8 | 8.3 | 9.4 | not measured | |

TABLE 5

| | balance water, in all compositions | | |
|---|---|---|---|
| | % by weight | | |
| Ingredient | Coating A | Coating B | Coating C |
| NTPA | 6.38 | 6.25 | 5.18 |
| $H_3PO_4$ | 6.38 | 6.25 | 4.15 |
| ZB | 0.00 | 0.00 | 1.16 |
| ZnO | 0.00 | 0.00 | 1.35 |
| NAB | 2.13 | 2.08 | 1.35 |
| PAA | 0.00 | 2.08 | 0.43 |
| APMA | 6 drops | 6 drops | 0.00 |
| EOP | 0.00 | 0.00 | 0.017 |

TABLE 6

| | contact angle, degrees | | | | | |
|---|---|---|---|---|---|---|
| Coating | Init. | 1 day | 4 days | 8 days | 10 days | 16 days |
| A-12 | 11.4 | 14 | 13 | 5 | 13 | 5 |
| A-13 | 8.0 | 15 | 8 | 7 | 16 | 12 |
| A-14 | 19.0 | 21 | 4 | 4 | 12 | 5 |
| A-15 | 16.2 | 9 | 8 | 10 | 15 | 11 |
| B-12 | 6.0 | 4 | 8 | 2 | 4 | 8 |
| B-13 | 5.2 | 3 | 4 | 4 | 6 | 7 |
| B-14 | 4.8 | 3 | 4 | 10 | 6 | 4 |

TABLE 6-continued

| | contact angle, degrees | | | | | |
|---|---|---|---|---|---|---|
| Coating | Init. | 1 day | 4 days | 8 days | 10 days | 16 days |
| B-15 | 6.8 | 5 | 4 | 2 | 3 | 5 |
| C | 4.6 | not measured | 8.8 | 11.4 | not measured | |

NOTE: The numerals 12, 13, 14 and 15 after "A" and "B" represent the number of seconds of drying time (at 300° C. oven temperature) of sample aluminum sheets coated with coatings A and B It is to be understood that the invention is not limited to the features and embodiments hereinabove specifically set forth but may be carried out in other ways without departure from its spirit.

I claim:

1. A composition for application to surfaces of aluminum articles to produce, upon heating, a nonabrasive, hydrophilic, corrosion resistant coating thereon, said composition comprising, in an aqueous vehicle, effective minor amounts of nitrilotrismethylenetriphosphonic acid, phosphoric acid, and borate material of the group consisting of zinc borate and sodium borate, the amount of nitrilotrismethylenetriphosphonic acid present being About 2.5 to about 7.8 parts by weight of nitrilotrismethylenetriphosphonic acid measured as a solution at 50% concentration, subject to the proviso that said material includes an effective amount of at least one borate, said coating formulation optionally also containing an effective minor amount of polyacrylic acid, said coating formulation being essentially free of silica, alumina and precursors thereof, and said amounts, in combination, being effective to provide a coating on said surface producing a stable contact angle with water of not more than about 15°.

2. A composition as defined in claim 1, wherein said amounts, in combination, are effective to provide a coating on said surface producing a stable contact angle with water of not more than about 10°.

3. A composition as defined in claim 1, wherein said amounts, in combination, are effective to provide a coating on said surface producing corrosion resistance such that when the coated surface is exposed to a 10% copper sulfate-1% hydrochloric acid solution, a period of at least about one minute elapses before gas bubbles appear.

4. A composition as defined in claim 1, wherein said borate material comprises zinc borate.

5. A composition as defined in claim 4, wherein said zinc borate comprises $2ZnO{\cdot}3B_2O_3{\cdot}3.5H_2O$ and additional ZnO.

6. A composition as defined in claim 1, further comprising an effective minor amount of polyacrylic acid.

7. A composition as defined in claim 1, comprising about 2.5 to about 7.8 parts by weight of nitrilotrismethylenetriphosphonic acid measured as a solution at 50% concentration, about 1.7 to about 6.1 parts by weight of phosphoric acid measured as 85% concentration $H_3PO_4$, about 0 to about 4.3 parts by weight of $2ZnO{\cdot}3B_2O_3{\cdot}3.5H_2O$, about 0 to about 2.6 parts by weight of ZnO, about 0 to about 0.9 parts by weight of polyacrylic acid, about 0.008 to about 0.17 parts by weight of surfactant, balance essentially water, subject to the provisos that the total of nitrilotrismethylenetriphosphonic acid and phosphoric acid present is between about 7.7 and about 12.1 parts by weight, that the total of $2ZnO{\cdot}3B_2O_3{\cdot}3.5H_2O$, ZnO, and sodium borate present is between about 1.3 and about 5.2 parts by weight, and that the amount of water present (exclusive of combined water, and water in the acid solutions) is between about 100-P and about 200-P parts by weight where P is the total parts by weight of ingredients other than water present in the formulation.

8. A composition as defined in claim 7, comprising about 2.9 to about 7.8 parts by weight of a nitrilotrismethylenetriphosphonic acid measured as a solution at 50% concentration, about 2.9 to about 5.2 parts by weight of phosphoric acid measured as 85% concentration $H_3PO_4$, about 0.8 to about 2.2 parts by weight of $2ZnO{\cdot}3B_2O_3{\cdot}3.5H_2O$, about 0.8 to about 2.6 parts by weight of ZnO, about 0.07 to about 0.43 parts by weight of polyacrylic acid, about 0.008 to about 0.10 parts by weight of surfactant, balance essentially water, subject to the provisos that the total of nitrilotrismethylenetriphosphonic acid and phosphoric acid present is between about 7.7 and about 11.2 parts by weight, that the total of $2ZnO{\cdot}3B_2O_3{\cdot}3.5H_2O$, ZnO, and sodium borate present is between about 1.3 and about 5.2 parts by weight, and that the amount of water present (exclusive of combined water, and water in the acid solutions) is between about 100-P and about 200-P parts by weight where P is the total parts by weight of ingredients other than water present in the formulation.

9. A composition as defined in claim 8, consisting essentially of about 5.19% nitrilotrismethylenetriphosphonic acid, about 4.20% phosphoric acid, about 1.73% $2ZnO{\cdot}3B_2O_3{\cdot}3.5H_2O$, about 2.02% additional ZnO, and about 0.43% polyacrylic acid, balance water, optionally also including up to about 0.1% of a surfactant.

10. A composition as defined in claim 1, wherein said borate material comprises sodium borate.

11. A composition as defined in claim 10, further comprising an effective minor amount of polyacrylic acid.

* * * * *